US005796322A

United States Patent [19]

Bridges et al.

[11] Patent Number: 5,796,322

[45] Date of Patent: Aug. 18, 1998

[54] APPARATUS TO SEAL AGAINST LEAKAGE OF HIGH FREQUENCY RADIATION THROUGH A SLOT

[75] Inventors: Mark Bridges, Leigh-on-Sea; Graham Michael Hood; Philip William Laurence Gandy, both of Chelmsford, all of Great Britain

[73] Assignee: EEV Limited, Chelmsford, England

[21] Appl. No.: 755,087

[22] Filed: Nov. 22, 1996

[30] Foreign Application Priority Data

Dec. 12, 1995 [GB] United Kingdom ..... 9525344.9

[51] Int. Cl.[6] ..... H01P 1/00

[52] U.S. Cl. ..... 333/248; 324/645; 333/99 R

[58] Field of Search ..... 333/209, 231, 333/232, 248, 99 R; 324/95, 637, 645

[56] References Cited

U.S. PATENT DOCUMENTS 2,996,692 8/1961 Christensen et al. ..... 324/95 X 3,140,342 7/1964 Ehrreich et al. ..... 333/248 X 3,419,826 12/1968 MacWilliams, Jr. et al. ..... 333/248

4,740,764 4/1988 Gerlack ..... 333/26

FOREIGN PATENT DOCUMENTS 035 440 A1 2/1981 United Kingdom .

*Primary Examiner*—Paul Gensler

*Attorney, Agent, or Firm*—Donald C. Casey, Esq.

[57] ABSTRACT

In high frequency apparatus such as for example an rf resonant cavity or a waveguide, it is often necessary to include a slot to permit a probe or other member to be located in the high frequency region and be moveable along the slot. Sealing means arranged adjacent to the slot and around the probe permits movement of the probe whilst minimising the open aperture area of the slot, hence preventing or reducing leakage through it. In one embodiment of the invention, the sealing means comprises a metallic mesh and in another it includes an elastomer material which is loaded with metallic material and/or carries a metallic mesh.

21 Claims, 2 Drawing Sheets

APPARATUS TO SEAL AGAINST LEAKAGE OF HIGH FREQUENCY RADIATION THROUGH A SLOT

FIELD OF THE INVENTION

This invention relates to high frequency apparatus and more particularly to apparatus in which a slot is included in a surface and it is required to reduce or prevent leakage of high frequency radiation through the slot.

BACKGROUND TO THE INVENTION

In high frequency arrangements such as those which employ, for example, rf resonant cavities or microwave waveguides, ideally, for most applications, surfaces of the high frequency components are continuous except where apertures form part of a high frequency circuit. However, it is often necessary to include a slot in a surface of the apparatus via which movement of a probe, mechanical linkage or other device located within the apparatus may be effected. Designers of such equipment pay careful attention to optimising the slot dimensions so as to minimise leakage of high frequency energy through the opening. However, particularly where the apparatus is to be capable of use over a large frequency range, there can be significant losses at certain wavelengths.

SUMMARY OF THE INVENTION

According to the present invention there is provided high frequency apparatus comprising a surface having a slot therein in which a member is moveable along the slot and sealing means for reducing or preventing leakage of high frequency radiation through the slot and which allows movement of the member along the slot.

By using the invention it is possible to provide a slot in a surface without it having a significantly detrimental effect on the apparatus over some or all of it operational frequency band. The member may be moved to different positions along the length of the slot.

The invention may be used to completely prevent leakage of high frequency radiation through the slot, say, or reduce such leakage to insignificant levels. The dimensions of the slot with which the sealing means is associated may, using normal design considerations, be optimised to achieve best performance over the frequency range at which it is wished to operate. However, by using the invention, these design constraints may be eased and the dimensions of the slot need not be so critical.

The slot may be located in a planar flat surface or in a curved surface. Although typically a slot may have an elongate rectangular shape with parallel facing sides, use of the invention may permit more complicated slot shapes to be used. The slot dimensions and its location need not be selected solely to minimize loss of high frequency energy through the slot. For example, an elongate slot having openings branching off a main aperture may be suitable, or the slot itself may be curved in the plane of the surface.

It is preferred that the sealing means comprises resiliently deformable means. The member may then displace the sealing means as it moves and the characteristics of the sealing means itself return it to cover the slot opening when the member is remote from that region of the slot. However more complex arrangements could be used instead in which there is no elasticity involved in making the seal and/or the sealing means is not deformable. For example, the sealing means could comprise a plurality of metallic plates arranged to pivot to cover and uncover the slot.

In one preferred embodiment of the invention, the sealing means has two parts arranged along the length of the slot with the member located between them. In an alternative embodiment, the sealing means may comprise a single strip and the member is located between that strip and an edge of the slot. However, the use of the two part arrangement would normally be preferred as this may be more easily arranged to substantially surround the member and hence provide good sealing.

The member may be included in a mechanical linkage means, for example, for allowing tuning plates within a resonant cavity to be adjusted or it may be part of a high frequency circuit, for example, forming part of a transmission path. In some arrangements the member may combine both functions or may be used for other purposes.

In one preferred embodiment of the invention, the sealing means includes an elastic material and electrically conductive material. The electrically conductive material is arranged to present a relatively continuous surface over most of the slot to prevent or reduce rf losses. The elastic material may be a synthetic or natural elastomer composition. The electrically conductive material may, for example, be distributed in the elastic material and/or arranged adjacent the surface of the elastic material, such as in the form of a mesh wrapped around the elastic material. For example the sealing means could comprise an elastomer in which is distributed a metallic material.

Where the sealing means comprises two strips the transverse sectional shape of each strip is in one advantageous embodiment of a "P" shape in which the larger, rounded end of each strip is located in or over the slot. However, the strip could have a 'C' shape section, or be hollow, for example. The elastomer material may be attached to the edge of the slot by an adhesive or other fixing means. The sealing means may alternatively comprise electrically conductive material configured such that it is deformable so that no separate elastomer is required. This may be achieved in several ways, for example, as a metallic mesh or a knitted material formed into a suitable shape, or as wire brushes.

In an advantageous embodiment, the sealing means comprises at least two joined components having respective different elastic and electrically conductive properties. Thus, a wire mesh arranged in a hollow cylinder may be located in an elastomer holder which in turn is fixed to the surface surrounding the slot. Separating the sealing means into two components which are then joined may facilitate manufacture and fitting and give a wider range of design options.

The sealing means may be one of a number of different constructions providing that there is a high frequency conductive path maintained to some extent at least across the slot.

The sealing means may substantially cover the slot although in some arrangements it may not extend along the whole length of the slot or completely cover the slot in a widthways direction even when the member is not present. The sealing means may be located in the slot itself or in part of the slot.

According to a feature of the invention, there is provided sealing means adapted for use in high frequency apparatus in accordance with the invention.

DESCRIPTION OF THE DRAWINGS

Some ways in which the invention may be performed are now described by way of example with reference to the accompanying drawings, in which.

DESCRIPTION OF PREFERRED EMBODIMENTS

Figure 1:
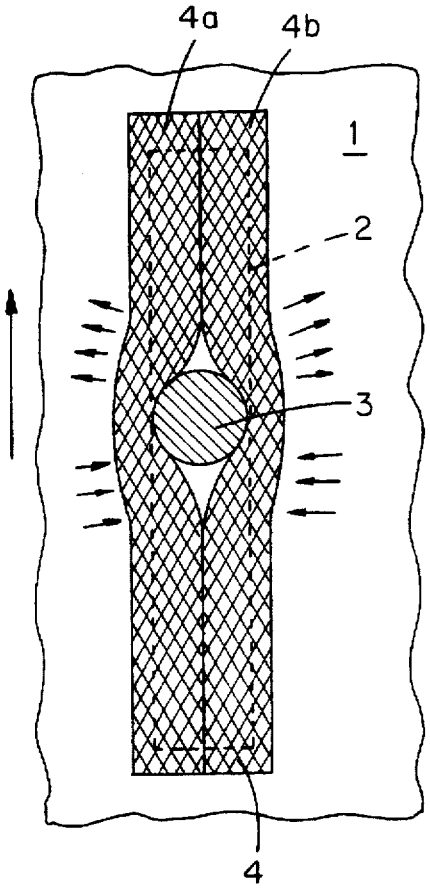
FIG. 1 is a plan schematic view of apparatus in accordance with the invention.

With reference to FIG. 1, a high frequency apparatus includes a wall having a surface 1 which forms part of a resonant cavity containing rf energy during use. The surface 1 has a rectangular elongate slot 2 therein, as indicated by the broken line. A cylindrical probe 3 is located through the slot 2, projecting into the cavity, and is moveable along the length of the slot, at a fixed insertion depth, to alter the performance characteristics of the apparatus. Sealing means 4 is positioned over the slot 2 and comprises two separate portions 4*a* and 4*b* fixed on opposite long sides of the slot with the probe 3 located between them. Each portion 4*a* and 4*b* of the sealing means comprises an elastomer core covered with a metallic mesh, the two portions of the sealing means being attached to the surface by conductive adhesive and positioned such that they are pushed together under compression. The sealing means 4 is deformed around the probe 3. When the probe 3 is moved along the slot 2 in the direction shown by the large arrow, the two portions 4*a* and 4*b* behind the probe 3 close together as shown by the small arrows. At the same time, the parts of the sealing means 4*a* and 4*b* in front of the probe 3 are pushed apart outwardly, as shown by the small arrows, to allow movement of the probe 3. As can be seen, only a small part of the slot aperture is uncovered by the sealing means or probe at any time.

Figure 2:
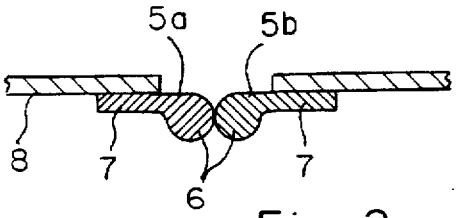
FIGS. 2 to 6 are schematic sectional views of sealing means in accordance with the invention.

Various configurations of the sealing means are illustrated in FIGS. 2 to 6 which are transverse sections relative to the slot length with the slot extending into the page as shown. In FIG. 2, the sealing means comprises two strips 5*a* and 5*b* of "P" transverse section with the rounded ends 6 being located over the slot. The flat ends 7 are attached to the surface 8 surrounding the slot by a suitable adhesive. The strips 5*a* and 5*b* are of knitted metallic mesh but in other embodiments may of be mesh over an elastomer core,, a metallic loaded elastomer or some other arrangement.

Figure 3:
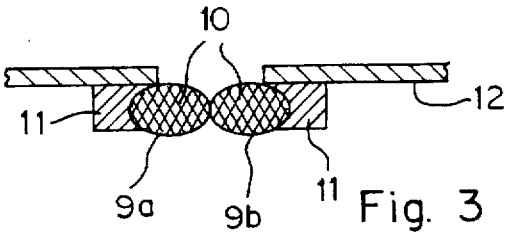

FIG. 3 shows another arrangement of the sealing means in which the sealing means is again in two portions 9*a* and 9*b*. Each portion 9*a* and 9*b* is in two parts, having a metallic mesh 10 which is attached to an elastomer carrier 11 which is in turn fixed to the surface 12. Again, the sealing means could alternatively be of other materials such as for example, a metallic mesh on an elastomer core in association with an elastomer or metal carrier.

Figure 4:
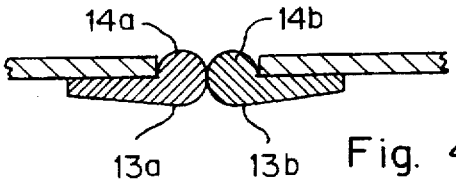

With reference to FIG. 4, another arrangement in accordance with the invention includes sealing means having two strips located along the length of the slot, the strips 13*a* and 13*b* having a "P" transverse section and arranged so that the rounded ends 14*a* and 14*b* of the strips are included in the slot aperture itself. As in the previously described embodiments, the materials which make up the sealing means may be chosen from a number of suitable alternatives.

Figure 5:
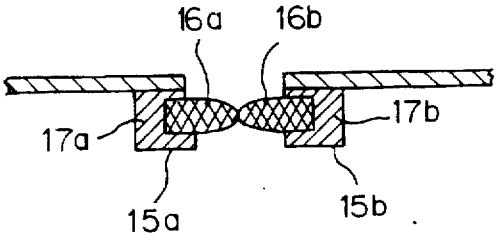

With reference to FIG. 5 the sealing means comprises two elongate strips 15*a* and 15*b* each of which has two components, an electrically conductive section 16*a* and 16*b* and a holder 17*a* and 17*b* having an appropriate shaped groove for receiving the conductive part of the sealing means. The holder may be a solid inelastic material fixed to the surface surrounding the slot, with elasticity of the sealing means being provided by the conductive material 16*a* and 16*b*, or it could be an elastomer material for example. The conductive material could be, for example, metallic mesh, an elastomer corded metallic mesh or a metallic loaded elastomer. There must be an electrically conductive path from the conductive material 16 and 16*b* to the surface surrounding the slot, and this may be achieved, for example, by metallising part of the holder surfaces.

Figure 6:
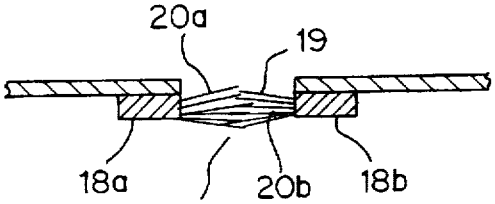

With reference to FIG. 6, sealing means 18 includes two metallic holders 18*a* and 18*b* attached to the surface along the long edges of the slot 19. The holders 18*a* and 18*b* each carry a wire brush 20*a* and 20*b* which face each other and are interleaved to act as a sealing means.

Figure 7:
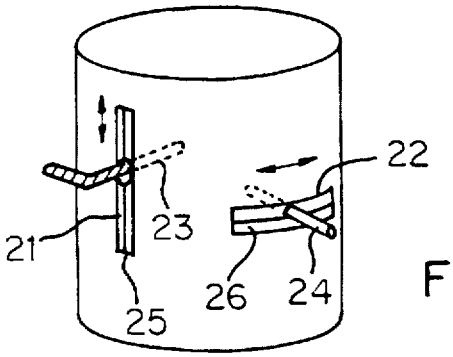
FIGS. 7 and 8 schematically illustrate an rf resonant cavity and a waveguide respectively which employ the invention.

With reference to FIG. 7, a cylindrical r.f. resonator cavity includes two slots, one of which 21 is arranged parallel to the longitudinal axis of the cavity and the other of which 22 is arranged in a circumferential direction around the surface of the cavity. In both cases a member 23, 24 is extensive through the slot 21, 22 into the cavity and is required to move along the length of the slot 21, 22. One of the members 23 is an electrical probe whilst the other 24 is a mechanical linkage used to move items located within the cavity. The members are positioned between parts of sealing means 25, 26 similar to that illustrated in FIG. 1.

Figure 8:
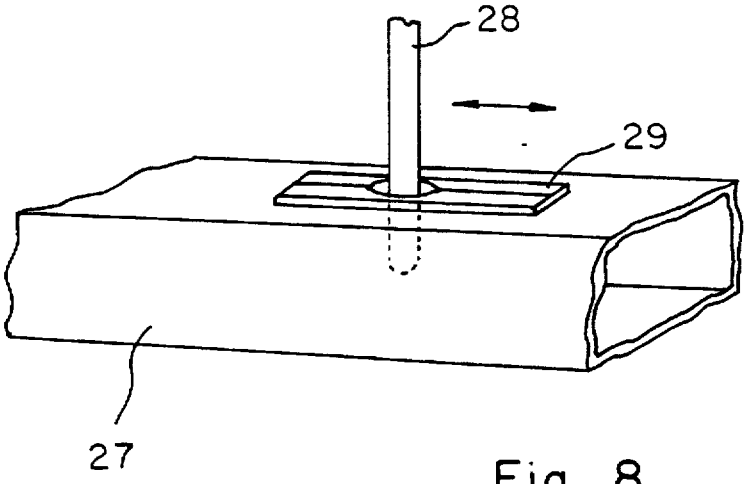

With reference to FIG. 8, a microwave waveguide 27 has a slot in which a probe 28 is located to allow movement of the probe 28 in the direction of the arrow. A seal 29 comprising two strips is located over the slot and surround the probe 28. The seal 29 is resiliently deformable and may comprise any of the configurations illustrated in FIGS. 1 to 6 or other alternatives which are not shown.

We claim:

1. High frequency apparatus comprising:

a component having a wall defining a region which in use contains high frequency radiation; a slot through said wall; a member extensive through said slot and moveable along said slot; and sealing means fixed relative to said wall and arranged at said slot to seal against leakage of high frequency radiation through said slot, said sealing means being such as to allow movement of said member along said slot.

2. High frequency apparatus as claimed in claim 1 wherein said sealing means comprises resiliently deformable means.

3. High frequency apparatus as claimed in claim 1 wherein said sealing means has two parts arranged along said slot and said member is located between said two parts.

4. High frequency apparatus as claimed in claim 3 wherein said sealing means comprises resiliently deformable means.

5. High frequency apparatus as claimed in claim 1 wherein said sealing means includes elastic material and electrically conductive material.

6. High frequency apparatus as claimed in claim 5, wherein said electrically conductive material is spatially distributed in said elastic material.

7. High frequency apparatus as claimed in claim 5 wherein said electrically conductive material is arranged adjacent a surface of said elastic material.

8. High frequency apparatus as claimed in claim 7 wherein said conductive material is a mesh.

9. High frequency apparatus as claimed in claim 7 wherein said conductive material is of a knitted construction.

10. High frequency apparatus as claimed in claim 1 wherein said sealing means comprises electrically conductive material having a configuration which is deformable.

11. High frequency apparatus a claimed in claim 10 wherein said electrically conductive material is a mesh.

12. High frequency apparatus as claimed in claim 10 wherein said electrically conductive material is of a knitted construction.

13. High frequency apparatus as claimed in claim 10 wherein said electrically conductive material is a wire brush.

14. High frequency apparatus as claimed in claim 1 wherein said sealing means comprises at least two components joined together and having respective different elastic and electrically conductive properties.

15. High frequency apparatus as claimed in claim 1 wherein said sealing means substantially covers said slot except where said member is located.

16. High frequency apparatus as claimed in claim 1 wherein said sealing means is located in said slot.

17. High frequency apparatus as claimed in claim 1 wherein said component is a high frequency resonator cavity.

18. High frequency apparatus as claimed in claim 1 wherein said component is a waveguide.

19. High frequency apparatus as claimed in claim I wherein said member is included in mechanical linkage means.

20. High frequency apparatus as claimed in claim I wherein said member is included in means for transmitting high frequency radiation.

21. Sealing means adapted for use in high frequency apparatus which apparatus comprises a component having a wall defining a region which in use contains high frequency radiation; a slot though said wall, and a member extensive through said slot and moveable along said slot wherein said sealing means is fixed relative to said wall and arranged at said slot to seal against leakage of high frequency radiation through said slot and said sealing means is such as to allow movement of said member along said slot.

* * * * *